US005317230A

United States Patent [19]

Tardy et al.

[11] Patent Number: 5,317,230

[45] Date of Patent: May 31, 1994

[54] AMPLIFIER VALVE WITH GRID HAVING RODS OF VARIABLE WIDTH

[75] Inventors: Michel-Pierre Tardy; Jean-Pierre Buge, both of Thonon, France

[73] Assignee: Thomson Tubes Electroniques, Boulogne Billancourt, France

[21] Appl. No.: 778,966

[22] PCT Filed: Apr. 23, 1991

[86] PCT No.: PCT/FR91/00334

§ 371 Date: Dec. 30, 1991

§ 102(e) Date: Dec. 30, 1991

[87] PCT Pub. No.: WO91/17559

PCT Pub. Date: Nov. 14, 1991

[30] Foreign Application Priority Data

May 4, 1990 [FR] France ..... 90 05640

[51] Int. Cl.[5] ..... H01J 1/46

[52] U.S. Cl. ..... 313/293; 313/295

[58] Field of Search ..... 313/293, 295, 348, 349

[56] References Cited

U.S. PATENT DOCUMENTS 1,948,122 2/1934 McCullough ..... 313/295 X
4,387,320 6/1983 Hoet ..... 313/293 X

FOREIGN PATENT DOCUMENTS 1134167 8/1962 Fed. Rep. of Germany .
1408119 6/1965 France .
2561820 9/1985 France .

*Primary Examiner*—Sandra L. O'Shea
*Attorney, Agent, or Firm*—Oblon, Spivak, McClelland, Maier & Neustadt

[57] ABSTRACT

A power amplifier valve with a grid is disclosed having improved reliability of operation and lifetime of the valve. A screen grid of a tetrode has a mesh grid with vertical or oblique rods in pyrolytic graphite. According to the invention, the rods are provided with a greater width at the bottom of the grid near the output of the valve where the high-frequency currents are greatest.

6 Claims, 1 Drawing Sheet

AMPLIFIER VALVE WITH GRID HAVING RODS OF VARIABLE WIDTH

BACKGROUND OF THE INVENTION

1. Field of the Invention

The invention relates to power amplifier valves, such as, for example, tetrodes.

2. Discussion of Background

The higher the power that valves are capable of delivering, the more energy losses in the valve have to be taken into account and eliminated in order not to risk bringing about deterioration or destruction of the valve by abnormal heating.

In valves operating at high frequency, losses are produced due especially to the circulation of currents at high frequency in the grids located between the cathode and the anode of the valves. In the case of a tetrode especially, the screen grid, most often called G2 grid, is traversed by high-frequency currents circulating vertically between the top and the bottom of the grid. These currents arise because the grid is placed in a resonant output circuit of the valve, and because, in every circuit resonating at high frequency, regions of standing waves are set up with nodes and antinodes of currents and of voltage. The highest ultra-high-frequency currents are certainly produced at current antinodes.

The grid is then subjected to very significant heating. It is not known precisely how to measure this heating (inside a closed vacuum valve) but the appearance of reverse grid currents has been noted when operating at very high power and high frequency. In other words, whereas the normal grid current is a consumption of current in one direction, it is noted that an increase in the operating power of the valve leads to the reversal of the direction of passage of the current in the grid connection. It has been noted, for example, that the grid current passed very rapidly from a normal positive value of a few amperes to a negative value of a few amperes (in a few seconds) during start-up of a tetrode.

This reversal of the grid current leads to the supposition that the grid starts to emit electrons in great quantity (whereas it ought not to do so). This emission of electrons is probably brought about by the increase in temperature of the grid. In fact, the material employed for the grid is most often of pyrolytic graphite, which has a relatively poor emissivity at the normal temperature of operation of the valve. It is thus probable that it is a very significant abnormal heating of the grid which confers a high thermo-emissivity on it. The quantity of current which can be measured, suggests that the grid attains temperatures of the order of 2000° C. Only such temperatures can in fact explain the appearance of such a high reverse grid current.

This high temperature of the grid may be the cause of malfunctions of the valve: the grid radiates a very significant quantity of heat towards the colder parts of the valve and brings about an abnormal outgassing of the latter. The ions liberated in the valve are then sources of electrical breakdowns, instances of tripping-off, etc. The grid insulation ceramics can deteriorate (cooling cracks) under the action of heat. In any event the result is a reduction in the reliability and the lifetime of the valves.

The aim of the invention is to reduce the risks of malfunction which seem to be due to an abnormal increase in temperature of the grid, in the valves whose grid is placed in a circuit resonating at high frequency and is traversed by high-frequency currents set up by this resonance.

SUMMARY OF THE INVENTION

According to the invention, it is proposed to utilise a grid having rods whose width is variable and is greater at the places where the high-frequency currents which circulate under the effect of the resonance are highest. For preference, the width varies along a rod between one side where the rod is subjected to weaker currents and another side where the rod is subjected to higher currents. In particular, in a certain number of cases, provision will be made for the width of the rods to be greater in the bottom of the grid (that is to say on the side of the connection towards the outside of the valve) than in the top.

In practice, it is in the case of valves with a cylindrical grid that the invention proves to be particularly attractive. The top of the grid is most often placed in a high-frequency current node and voltage antinode, but the bottom is much closer to a current antinode.

In one embodiment, the rods have a width which grows uniformly towards the bottom of the grid. The growth can be continuous or discontinuous.

The invention is applicable to grids with vertical rods or grids with oblique rods. In fact, grids are often constructed with oblique rods in order to improve the mechanical strength of these grids.

In practice, the invention is intended above all for application to the grids produced by machining or cutting-out, such as grids in pyrolytic graphite machined by sandblasting or grids in molybdenum cut out with a laser by electroerosion or by stamping.

BRIEF DESCRIPTION OF THE DRAWINGS

Other characteristics and advantages of the invention will become apparent on reading the detailed description which follows and which is given by referring to the attached drawings, in which.

DETAILED DESCRIPTION OF THE PREFERRED EMBODIMENTS

The invention will be described in detail in the context of a high-power triode or tetrode grid, having a cylindrical cathode, one cylindrical grid (triode) or two cylindrical grids (tetrode) of mesh structure surrounding the cathode, and an anode surrounding the grid. Clearly, however, the invention is applicable to other valve structures where the same problems are encountered (anode surrounded by the grids and the cathode, for example).

The grid, whether it is a modulation grid (G1) or a screen grid (G2), very often (and it is this case above all which is of interest here) consists of a sheet of refractory material in a cylindrical shape machined into a mesh structure.

The function of these grids is to establish a fixed potential distribution in the vicinity of the cathode, while letting through the major part of the flow of electrons emitted by the cathode towards the anode. The rods of the mesh structure are sufficiently close to one another to make it possible to establish potentials distributed as well as possible, yet they are sufficiently well separated from one another by the free space of the meshes to let through as large a proportion of the electrons as possible.

In conventional grid structures, this compromise is reached with networks of rods forming uniform meshes. The rods are either vertical rods (to permit optimal removal of the high-frequency currents as these propagate from top to bottom on account of the distribution of the high-frequency potentials along the height of the cylindrical grid), or oblique crossed rods (to improve the mechanical strength of the structure). The rods are very thin with respect to the gaps between the rods. The vertical direction conventionally chosen here is the axis of the cylinder constituting the grid.

Figure 1:
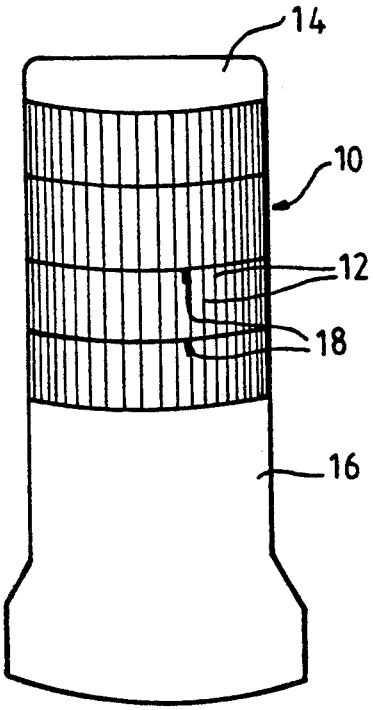
FIG. 1 illustrates an example of a conventional power tetrode grid.

FIG. 1 illustrates a conventional high-power amplifier valve grid. Here it is a grid in pyrolytic graphite, but that could also be a grid in metal. The grid 10 is, in essence, constituted by a network of vertical rods 12 extending between the top 14 of the grid and the bottom 16. The grid is connected electrically to the exterior of the valve by a contact taken to the bottom of the grid and not illustrated.

In the following description, when speaking of the bottom of the grid it is the connection side which will be referred to.

From place to place, horizontal circular rods 18 permit mechanical linking of the vertical rods to one another with a view to enhancing the rigidity of the structure.

The horizontal rods contribute little or nothing to the removal of the currents in the grid. Very few high-frequency currents are developed in the horizontal rods. On the other hand, the vertical rods are the site of high-frequency currents which, in this type of structure, are all the higher the nearer they are to the bottom of the grid.

The reason for this is that the grid is most often placed in a circuit resonating at high frequency in which the top of the grid is at a current node and a voltage antinode, while the bottom of the grid is close to a current antinode.

Figure 2:
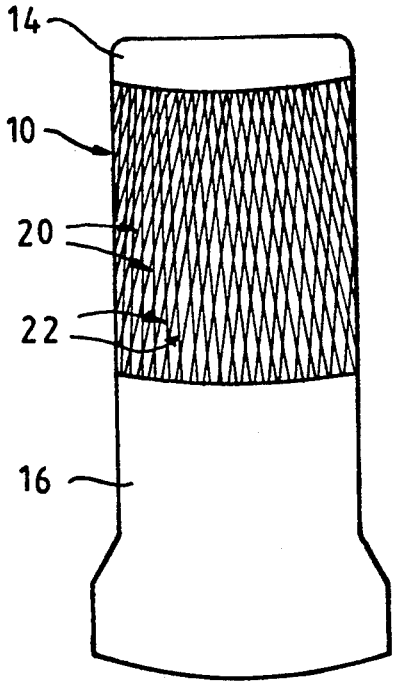
FIG. 2 illustrates another example of a conventional grid, with oblique rods.

FIG. 2 illustrates another conventional grid structure in pyrolytic graphite. In this structure, the rods are oblique and there are two networks of crossed oblique rods 20 and 22. The assembly forms a network with lozenge-shaped meshes. Although it has not been illustrated in FIG. 2, there could in addition be horizontal, circular rods in order to increase the rigidity; for example, there can be horizontal rods linking the crossing points of the two oblique networks, so as to transform the lozenge-shaped meshing into a triangular meshing (each lozenge divided into two triangles). These horizontal rods would also be provided there in order to increase the rigidity of the structure.

Just as in the case of FIG. 1, in the case of FIG. 2 the rods have widths which are constant from top to bottom of the grid.

According to the invention, it is proposed to give to the vertical or oblique rods widths which are variable as a function of the distribution of high-frequency current densities in the grid for the desired operation of the valve (that is to say especially for a desired power and frequency). Where the current density tends to be greater, wider rods will be utilised.

The increase in the width of the rod permits an increase in the effective cross-section traversed by the currents, thus a reduction in the power dissipated by Joule effect.

Moreover, this increase in width permits an increase in the radiating surface of the rod. For the same power dissipated by Joule effect and removed principally by radiation (very slight removal by thermal conduction in these cylindrical grid structures and even slighter by convection as it is in a vacuum), the temperature of the rod will be reduced.

The currents at different points in the grid can be calculated from the Maxwell equations; the currents and potentials in fact follow well-known physical and mathematical laws; thus it can be determined which are the places (for a fixed operation) where the current density will be the highest, and at these places the rods are given a wider cross-section.

In practice, the current density in the rods of the grid is often very high in the bottom of the grid, on the side of the connection, for a cylindrical grid conventionally having one connection on only one side of the cylinder.

In one particular preferential embodiment, the width of the rods goes on growing from the top of the grid towards the bottom, at least in the lower part of the grid.

Thus are obtained rods of non-uniform width in proportion to the distance covered along their length, the rods being wider where the currents which are liable to traverse them are the highest, and where, as a consequence, the temperature of the grid has the greatest risk of rising too high.

In practice, in what will be the most usual cases, the choice will thus be to give the vertical rods a growth in width at the bottom of the grid. The vertical rods are in fact the most affected by the problems of circulation of high-frequency currents, and it is at the bottom of the grid that the risks of abnormal heating are the highest.

For example, the vertical rods have a continuously variable width from the top to the bottom of the grid. But the variation can also be in steps.

Or, again, the vertical rods have a constant width over one part of the height of the grid, then, towards the bottom, the width grows regularly or in steps.

For oblique rods, the solutions are the same: growth which is continuous or in steps, from the top of the grid or only in the lower part of the grid.

The horizontal rods themselves can be wider towards the bottom of the grid than towards the top, if only for ease of fabrication.

Figure 3:
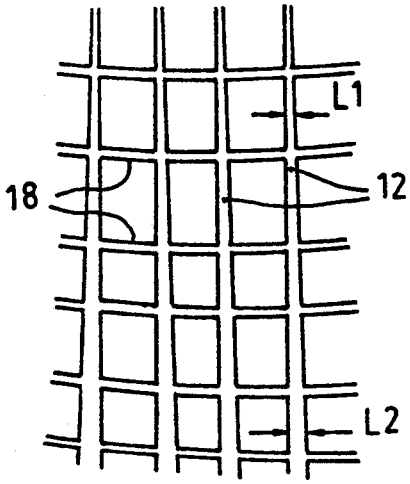
FIG. 3 illustrates an embodiment of a grid according to the invention, with vertical rods.

FIG. 3 illustrates one example of the composition of a grid, for vertical rods: the width (L1, L2) of the rods goes on growing towards the bottom. This figure illustrates a detail of the grid; the proportions are not correct, for reasons of ease of presentation, so that the increase in width of the rods can be clearly seen; in practice, the rods can in fact be very thin compared with the gap between consecutive rods; on the other hand, the gap between horizontal rods can be much wider than the gap between vertical rods.

The width of the openings between rods can be constant or otherwise: it is simplest to utilise a meshing of constant pitch, which implies that the openings are reduced as the rods are widened. The transparency of the grid to the electrons thus reduces where the rods are wider, but this is acceptable for two reasons:

on the one hand, the width of the rods may remain slight in comparison with the opening even where the rods are widest;

on the other hand, most often the widest rods will be precisely in the regions (bottom of the grid) where the electronic current density given off by the cathode and recovered by the grid G2 is weakest.

The invention is applicable in the same way to grids whose rods are not vertical but oblique, as for example a grid such as that of FIG. 2 comprising a series of oblique rods, all parallel and crossed by another series of all-parallel oblique rods.

Figure 4:
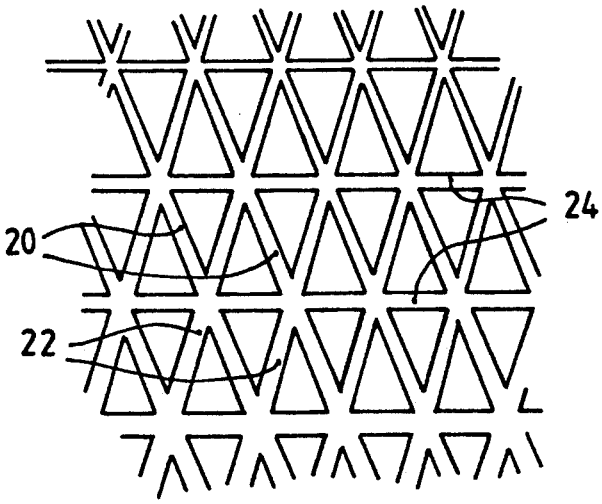
FIG. 4 illustrates another embodiment for a grid with oblique rods.

An example of embodiment of the invention with a grid with oblique rods reinforced by horizontal rods (triangular meshing) is illustrated in FIG. 4. It is seen that the two networks of oblique rods 20 and 22 have a growth in width from the top towards the bottom. The horizontal rods 24 also have growth in width from the top towards the bottom, but only for reasons of ease of fabrication; they could all have the same width as the heating due to the circulation of current in these horizontal rods is slight.

The grids can be in pyrolytic graphite; they are then generally cut out by sandblasting by means of sandblast nozzles.

Provision may also be made for the grids to be in metal (for preference in molybdenum). They are then produced by cutting-out with a laser or by mechanical cutting-out or by electroerosion.

We claim:

1. A high-frequency electronic amplifier valve, comprising:

an anode and a cathode arrangement having a grid structure between said anode and said cathode wherein said cathode functions with said grid structure to establish a fixed potential distribution in the vicinity of said cathode while providing for electron flow emitted by said cathode toward said anode;

wherein said high-frequency valve has high-frequency currents circulating between one end of said valve and a second end of said valve wherein said second end is an output end of said valve and wherein said grid is positioned in a resonant output circuit of said valve formed by said anode and said cathode and wherein current antinodes are produced in the vicinity of said second end of said valve with said current antinodes providing maximum high-frequency currents;

said grid structure including a plurality of rods whose width is variable along the length of the grid and wherein the rods with greatest width are near said second end of said valve where said high-frequency current is at its highest value.

2. The electronic amplifier valve according to claim 1, wherein said grid is in the shape of a vertical cylinder extending between said first and second ends of said valve and wherein said rods are vertical or oblique with respect to vertical.

3. The electronic valve according to claim 1, wherein said grid structure is one of pyrolytic graphite or metal.

4. The electronic valve according to claim 1, wherein said rods have a constant width over one portion of the length of the grid and a variable width over another portion of the length.

5. The electronic valve according to claim 1, wherein said rods have a proportional increase in width as they extend from said first end toward said second end which said second end is the output end of said valve.

6. The electronic valve according to one of claim 1–5 wherein the valve is a tetrode and said grid is a screen grid of tetrode.

* * * * *